United States Patent [19]

York

[11] 4,000,897

[45] Jan. 4, 1977

[54] GAME APPARATUS

[76] Inventor: David S. York, 2 Beechwood Lane, Garnerville, N.Y. 10923

[22] Filed: Mar. 27, 1975

[21] Appl. No.: 562,667

[52] U.S. Cl. ..... 273/93 C; 273/134 C; 273/134 D; 273/134 AT; 273/93 R

[51] Int. Cl.[2] ..... A63F 3/00

[58] Field of Search ..... 35/9; 273/93, 134, 152

[56] References Cited

UNITED STATES PATENTS

| | | | |
|---|---|---|---|
| 298,192 | 5/1884 | Foote | 273/93 R |
| 1,349,190 | 8/1920 | Duncan | 273/93 R |
| 1,528,060 | 3/1925 | Joyce | 273/152 R |
| 1,635,734 | 7/1927 | Ziegler | 273/134 AC |
| 3,171,214 | 3/1965 | Sutherland | 35/9 R |

FOREIGN PATENTS OR APPLICATIONS

| | | | |
|---|---|---|---|
| 184,517 | 8/1922 | United Kingdom | 273/134 AT |
| 867,150 | 5/1961 | United Kingdom | 273/134 AT |
| 1,007,792 | 10/1965 | United Kingdom | 273/134 AT |

*Primary Examiner*—Delbert B. Lowe

[57] ABSTRACT

A game apparatus is provided in which a special game element is included. The game element comprises decks of cards or the like having spelling words of varying complexity contained therein. Each deck includes words to be spelled which are grouped in accordance with a specific level of academic achievement. Thus one deck may contain words to be spelled by a second grade student, another deck for a third grade student and so forth. At the beginning of the game, the players select a deck which represents their level of learning and that deck is used in the random selection of words throughout the game. When a player performs a desirable act in the playing of the game, such as moving to a lucky space on a gameboard, he may keep that move only upon successfully spelling a word selected from his preselected deck of cards. While the decks may be used in many types of games, the invention is particularly described herein in terms of a baseball game.

1 Claim, 4 Drawing Figures

GAME APPARATUS

FIELD OF THE INVENTION

This invention relates to games, and more specifically to a game in which decks of cards containing spelling words of varying degrees of complexity are employed to implement the rules of the game.

DESCRIPTION OF THE PRIOR ART

One of the more significant commercial industries which has world wide application is the toy industry. An important segment of this industry is that portion which is directed to games. Literally thousands of games of all kinds have been invented and many hundreds of such games are available at retail outlets. Because of their wide appeal, games are tailored not only for children but for adults and children alike. In view of the commercial importance to manufacturers and the stong appeal to the public consumer, new games are continuously appearing on the market and older games strive to become standards in the marketplace.

Generally, games can be placed in two categories, games of chance and educational games. By far the greater number of available games are games of chance in which a spin of the wheel or a toss of the dice determines for the most part which of the players wins the game. Such games are probably appealing because any number of people can play such games with no more skill required than the movement of a hand. The disadvantage of such games, especially to children, is that knowledge and talent are totally useless in playing of the game and thus many hours are spent without intellectual or psychological enrichment of any kind. The primary purpose of such games therefor appears to be confined to that of occupying children's time in an entertaining manner, and this of course is the goal of many parents. On the other hand, games requiring skill or knowledge of the players also occupy time and at the same time provide opportunity for a player to excel on a basis other than pure chance. So, for example, games such as Password and Scrabble which require individual ability have become very successful and are widely accepted. The utltimate game, however, may well be a game in which both skill and chance prevail. One such game is Monopoly which continues to reign supreme among games. Here not only chance (toss of dice) but judgment leads to success in the game. All too often, however, such games are unavailable primarily because it is difficult to combine chance and skill in a single game. Any such game, it would appear, would have a better than average chance for success.

DESCRIPTION OF THE INVENTION

It is therefore a primary object of this invention to provide a game which combines skill or knowledge with chance in the performance of the game.

It is another object of this invention to improve games already available by the simple addition of a single playing element so that any game of chance may be converted to a game of skill and chance.

Broadly, the invention comprises a game in which a game element involving the ability of a player to spell is employed. This game element is preferably a plurality of cards arranged in decks or groups. Each card in a group contains a list of words to be spelled and all cards in a single deck have similar words requiring knowledge of a specific level of academic achievement. Thus, one deck may contain words requiring the skill of a second grade student to spell, while another deck may contian words requiring the skill of a third grader to spell and so forth. A deck containing adult spelling words may also be included. Such a game element may be added to virtually any game of chance by requiring a player to spell a word from one of the decks before completing a move in the game. For example, if a game includes a gameboard having defined spaces thereon and a movable piece which moves from space to space in accordance with a toss of dice or the like, a player's movement of his piece may be made to depend upon successful spelling of a word from a deck which respresents his level of academic achievement. In view of the various spelling decks which may be tailored for all age levels, third grade students may play with high school students, and parents may play with their children. Any such game therefore has wide appeal since it may be played by anyone and also combines both skill and chance.

The present invention is particularly adaptable for use in a game which includes a gameboard and pieces which move over the gameboard in accordance with prescribed rules of play. For the purposes of providing one preferable embodiment of the invention, this description will hereafter be concerned with one such type of game. Specifically, the invention will be described with respect to a conventional game of baseball which comprises a gameboard, a plurality of defined playing spaces on the board each containing an indicia indicative of conventional baseball activity such as a walk, out, homerun, etc. and game pieces which move over the spaces in response to a toss of the dice or the like. The spaces are preferably provided about the periphery of the gameboard surface so that a representation of a baseball field may be placed in the central portion of the board. Small replicas of baseball men may be employed to move around the bases of the playing field to provide additional interest. A scoreboard may also be added for convenience in tallying the runs scored by the various players. Finally, the decks of spelling cards are employed in conjunction with the toss of dice to control the movement of pieces over the spaces and the scoring of runs. This may be accomplished in a variety of ways such as by requiring correct spelling of a word as a condition precedent to maintaining a desirable space which has been achieved by a toss of dice. Detailed rules of playing the illustrative game of baseball using the spelling decks are more fully described hereinafter.

DESCRIPTION OF THE DRAWINGS

The invention is more fully described by reference to the drawing in which.

Figure 1:
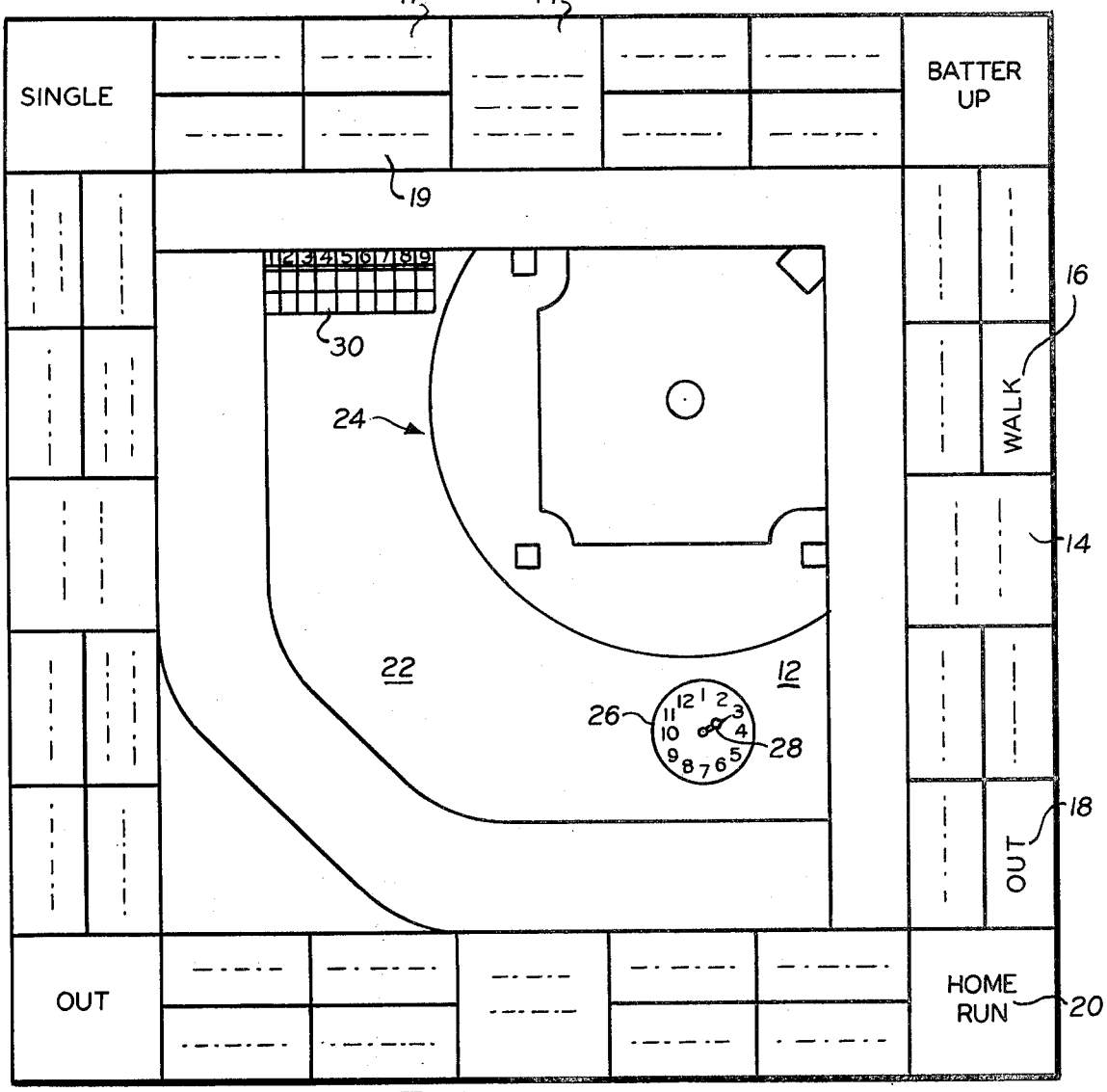
FIG. 1 is a plan view of a gameboard typical of those useful in the subject invention.
Figure 3:
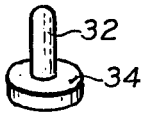
FIG. 3 is an illustration of a game piece which may be used in conjunction with the gameboard of FIG. 1.
Figure 4:
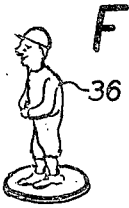
FIG. 4 is an illustration of a replica of a baseball player which may also be used in conjunction with the gameboard of FIG. 1.

Referring now to the drawing, and particularly FIG. 1, there is shown a gameboard 10 which includes a playing surface 12. The playing surface 12 includes a plurality of defined spaces 14 on which various indicia representative of the mode of activity of conventional baseball play are depicted such as at 16, 18 and 20. Certain of the spaces 14 are provided with two sections such as at 17 and 19. This is to allow a player who lands on such a space and who already has men on base to select section 17 while a player with no men on base would select section 19. The spaces 14 are confined in this embodiment to the outer periphery of the playing surface 12 and the central portion 22 includes a replica of a conventional baseball field generally designated by the numeral 24. The gameboard 10 may also include a device 26 having a plurality of numerals on its face and a dial 28 which is adapted to spin. This conventional device 26 enables a player to select a number at random by spinning dial 28. Obviously, a set of dice or other such numeral selecting means may be employed. A scoreboard 30 may also be included for the convenience of the players. Game pieces such as depicted by the numeral 32 in FIG. 3 which are adapted to slidably move over gameboard 10 by means of the base 34 are used by the game players to move from one space 14 to another in a standard manner. The replica 36 of a baseball player shown in FIG. 4 may also be provided to each player for movement around the playing field 24 to more nearly duplicate an actual game of baseball.

Figure 2:
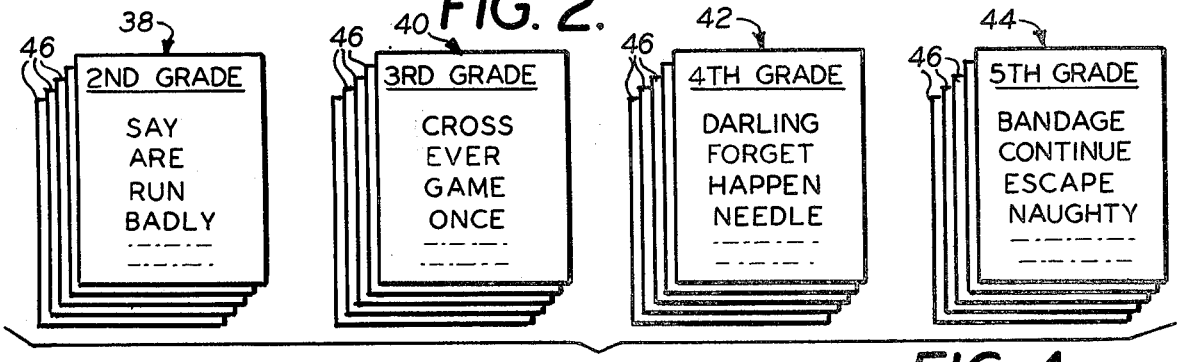
FIG. 2 illustrates several decks of cards containing words to be spelled in playing a game with the gameboard of FIG. 1.

FIG. 2 illustrates a plurality of decks of cards 38, 40, 42 and 44. Each of such decks includes a number of individual cards 46 each of which contains a plurality of words listed thereon. The words are selected and grouped in a single deck in accordance with the degree of difficulty encountered when spelling such words. Each deck then represents a spelling challenge for an individual of a particular level of academic achievement, spelling ability or age. Thus deck 38 is designed for a second grade student, deck 40 for third grade, deck 42 for fourth grade and deck 44 for fifth grade. Obviously, any number of decks of progressively greater difficulty may be used.

The use of the decks of spelling cards in conjunction with the gameboard 10 will now be more fully explained with reference to the following baseball game instructions.

Object of the game:

The object of the game is for each player to score as many runs as possible.

Determining the batting order:

A spin of the dial 28 determines a player's position in the batting order. Players move in order starting with a high number down to a low number. All players will repeat this procedure if 2 or more players spin the same number.

Determining color:

Each player selects a different colored playing piece 32.

The "Batter Up" space will be used only on the player's first spin of the dial. If the player's piece ends up in this space as it moves around the board it will be relocated one space to the right.

Starting the game:

The piece 32 is placed in the space marked "batter up". The player then spins the dial 28. The piece 32 may only be moved to the right (counter clockwise) the number of spaces indicated by the spin of the dial. Play continues from the space where the piece was moved to.

Outs:

a. A player is out when he moves to a space where an out is indicated or fails to spell a word correctly.

b. In the event the player at bat fails to spell a word correctly with a runner or runners on base the batter is out and all base runners return to the bases they originally occupied.

c. Certain spaces indicate a double play. All double plays will involve the lead base runner and the runner immediately behind him. All other base runners or the batter runner will be considered safe at the base they would normally be moving to.

Spelling cards:

a. Before the game begins players should choose a deck of cards on their grade level. No player should pick cards more than one level below his current grade in school.

b. 2, 3 or 4 players may spell from the same set of cards.

c. Players must spell one word correctly after they get a walk, hit, runner on base, move a base runner up at least one base or score a run or runs.

d. The spelling cards should be set with the words face down. The cards must be put on the very bottom of the deck after one word is read off of it.

e. Spelling cards are picked from the top of the proper deck and read by the next player in the batting order.

f. Each card has 12 words on it. The word read to the player at bat is the same number that was on the batter's last spin of the dial. Exception: the reader has the option of substituting No. 1 word on the card for the word indicated by the spin of the dial.

g. A player who can not read the word on the card properly may get help from any other player but the batter.

h. No player may aid the batter in spelling any word.

i. A player has the option of either spelling the word orally or writing it on paper.

General rules of play:

The general rules of play are consistent with the rules of baseball. A player receives 3 outs per inning, 9 innings constitute a complete game and a game ending in a tie after 9 innings should be played until completion by all players.

It will be appreciated that the invention is particularly suited to a game such as baseball or other sports type games. However, it is also applicable in many other games of chance and adds a new dimension to any game. The cards employed in the game and, more specifically, the use of certain groups or clusters of words representing a particular level of achievement are shown by the following examples which list words selected for various school grade levels.

EXAMPLE 1

| Spelling Words Grade 2 | | |
|---|---|---|
| bad | act | as |
| go | fur | fun |
| look | king | kid |
| book | seal | mouse |
| car | can | stay |
| badly | top | tar |
| goat | rise | big |
| wet | cap | sand |
| lost | seed | kind |
| sit | let | funny |
| cow | give | at |
| win | baby | toy |

EXAMPLE 2

| Spelling Words Grade 3 | | |
|---|---|---|
| cross | girl | jump |
| ever | hike | lion |
| game | lady | napkin |
| home | newspaper | order |
| just | pack | quick |
| little | rabbit | rattle |
| narrow | said | take |
| over | tell | watch |
| quit | winter | because |
| round | became | build |
| tame | bring | door |
| window | backwards | every |

EXAMPLE 3

| Spelling Words Grade 4 | | |
|---|---|---|
| darling | handle | matter |
| forget | large | package |
| happen | nation | quiet |
| laugh | paint | saucer |
| needle | quite | toward |
| parade | scale | wonder |
| radio | travel | march |
| scare | wrong | found |
| truth | lovely | bacon |
| written | grant | carriage |
| department | balloon | drown |
| greet | control | fight |

EXAMPLE 4

| Spelling Words Grade 5 | | |
|---|---|---|
| bandage | surface | shake |
| continue | thousand | spill |
| escape | world | stitch |
| furniture | banner | surprise |
| important | country | throat |
| leather | especially | whisper |
| native | general | beautiful |
| pleasure | include | dangerous |
| review | lemonade | excite |
| seventeen | naughty | gymnasium |
| spent | possible | increase |
| station | science | library |

EXAMPLE 5

| Spelling Words Grade 6 | | |
|---|---|---|
| breathe | silent | product |
| bless | squirrel | remember |
| church | vacation | settlement |
| consider | buffalo | sincerely |
| diamond | central | stomach |
| entertainment | citzen | valentine |
| government | constitution | bushel |

EXAMPLE 5-continued

| Spelling Words Grade 6 | | |
|---|---|---|
| mountain | distance | century |
| polar | errand | cloak |
| probably | governor | cough |
| remainder | museum | ditch |
| separate | population | examination |

Of course, many additional words may be selected for any of the above lists and, furthermore, many other levels of words are available. The above examples are therefore intended to be illustrative of some of the various levels of academic achievement which could be involved in the playing of the game of this invention.

It will be appreciated from the foregoing that the subject invention achieves the ultimate in providing both the element of chance and the element of knowledge or skill in a game apparatus. By the use of decks of cards or the like in which lists of spelling words are grouped according to degree of difficulty, a new and delightful addition is made to a normal game of chance. Baseball, football and indeed any typical game may be supplemented by urging the players, both children and adults, to exhibit and improve their spelling skills while playing the game. By at least partially enabling the outcome of a game to depend upon spelling skill, a new learning and motivating factor enters an otherwise tedious and fruitless game. Moreover, the use of such a game as an adjunct to the learning habits of youngsters in early grade school levels may prove to be most significant in many cases. It is apparent, therefore, that the subject invention provides a major addition to the game industry.

What is claimed is:

1. A game apparatus consisting essentially of a game board having a plurality of defined spaces each marked with indicia representative of a mode of activity in respect of game play, a plurality of game pieces adapted to be moved over said spaces by a player, chance means for determining the extent of movement of said game pieces on said game board, a plurality of card decks, each deck having at least one card therein, each of said cards in a deck having solely spelling words listed thereon, the spelling words of each deck being selected to represent a different grade school level of academic achievement, in which said indicia on said spaces contain information representative of a mode of activity in a conventional game of baseball, said defined spaces are positioned sequentially about the periphery of the playing surface of said game board, and the central portion of said game board is provided with a representation of a conventional baseball field.

* * * * *